US009183702B2

(12) United States Patent
Stevens et al.

(10) Patent No.: US 9,183,702 B2
(45) Date of Patent: Nov. 10, 2015

(54) GAMING MACHINE WITH MINE FEATURE

(75) Inventors: Christopher Stevens, Rosebery (AU); Stephen Johnson, Rosebery (AU)

(73) Assignee: ARISTOCRAT TECHNOLOGIES AUSTRALIA PTY LTD (AU)

( * ) Notice: Subject to any disclaimer, the term of this patent is extended or adjusted under 35 U.S.C. 154(b) by 648 days.

(21) Appl. No.: 10/690,852

(22) Filed: Oct. 21, 2003

(65) Prior Publication Data

US 2004/0127278 A1 Jul. 1, 2004

(30) Foreign Application Priority Data

Oct. 29, 2002 (AU) ..... 2002952319

(51) Int. Cl.
*G07F 17/32* (2006.01)

(52) U.S. Cl.
CPC ..... *G07F 17/3262* (2013.01); *G07F 17/32* (2013.01); *G07F 17/3267* (2013.01)

(58) Field of Classification Search
USPC ..... 463/20–21, 16, 25–26; 273/274
See application file for complete search history.

(56) References Cited

U.S. PATENT DOCUMENTS

| | | | | |
|---|---|---|---|---|
| 5,931,467 | A * | 8/1999 | Kamille | 273/139 |
| 6,159,097 | A * | 12/2000 | Gura | 463/20 |
| 6,203,429 | B1 * | 3/2001 | Demar et al. | 463/20 |
| 6,254,481 | B1 * | 7/2001 | Jaffe | 463/20 |
| 6,312,334 | B1 * | 11/2001 | Yoseloff | 463/25 |
| 6,364,767 | B1 * | 4/2002 | Brossard et al. | 463/20 |
| 6,368,216 | B1 * | 4/2002 | Hedrick et al. | 463/20 |
| 6,506,118 | B1 * | 1/2003 | Baerlocher et al. | 463/25 |
| 6,702,670 | B2 * | 3/2004 | Jasper et al. | 463/20 |
| 6,755,738 | B2 * | 6/2004 | Glasson et al. | 463/19 |
| 6,767,283 | B1 * | 7/2004 | Weiss | 463/16 |
| 6,835,132 | B2 * | 12/2004 | Bennett | 463/16 |
| 7,001,278 | B2 * | 2/2006 | Maya et al. | 463/26 |
| 7,029,395 | B1 * | 4/2006 | Baerlocher | 463/20 |
| 7,530,892 | B2 * | 5/2009 | Jordan et al. | 463/20 |
| 2001/0004607 | A1 * | 6/2001 | Olsen | 463/26 |
| 2002/0010018 | A1 * | 1/2002 | Lemay et al. | 463/20 |

(Continued)

FOREIGN PATENT DOCUMENTS

GB 2114347 A * 8/1983

OTHER PUBLICATIONS

Ken Moberly. Understanding the PAR Sheet.. The manufacturer's theoretical hold computation work sheet. PAR—Probability and Accounting Report. Retrieved Nov. 21, 2006 http://ag.arizona.edu/rtip/Symposium/2005%20Symposium/05%20symposium%20images/PAR%.*

(Continued)

*Primary Examiner* — Tramar Harper
(74) *Attorney, Agent, or Firm* — McAndrews, Held & Malloy, Ltd.

(57) ABSTRACT

A gaming machine has a display and a game controller arranged to control images of symbols displayed on the display. The game controller is arranged to play a game wherein at least one random event is caused to be displayed on the display means and, if a predefined winning event occurs, the machine awards a prize. The gaming machine further comprises a game feature where, upon being awarded at least one prize in the feature, a player is offered a choice and, if the choice results in a successful outcome, the player has the option of continuing with the feature but, if the choice results in an unsuccessful outcome, the feature ends and a portion, but not all, of a total prize accumulated up to termination of the feature is forfeited.

12 Claims, 8 Drawing Sheets

(56) References Cited

U.S. PATENT DOCUMENTS

| | | | | |
|---|---|---|---|---|
| 2002/0107066 | A1* | 8/2002 | Seelig et al. | 463/20 |
| 2002/0142823 | A1* | 10/2002 | DeMar et al. | 463/16 |
| 2002/0195773 | A1* | 12/2002 | Dunn | 273/274 |
| 2003/0045350 | A1* | 3/2003 | Baerlocher et al. | 463/25 |
| 2003/0060256 | A1* | 3/2003 | Joshi | 463/16 |
| 2003/0100356 | A1* | 5/2003 | Brown et al. | 463/9 |
| 2003/0100361 | A1* | 5/2003 | Sharpless et al. | 463/25 |
| 2003/0104861 | A1* | 6/2003 | Gaidarev et al. | 463/25 |
| 2003/0176215 | A1* | 9/2003 | Palmer et al. | 463/25 |
| 2004/0176157 | A1* | 9/2004 | Walker et al. | 463/16 |
| 2005/0110215 | A1* | 5/2005 | Jackson | 273/292 |

OTHER PUBLICATIONS

Nevada Gaming Commission and State Gaming Control board, Minimum Internal Control Standards. http://gaming.nv.gov/audit_mics.htm. Retrieved Mar. 29, 2007.*

State of Nevada Gaming Control Board, Minimum Internal Control Standards of 1997 Slots. http://gaming.nv.gov/documents/pdf/ic_slots.pdf. Retrieved Mar. 29, 2007.*

IGT Promo "Beetle Bailey's Roll for Rank" retrieved from the Internet Dec. 5, 2007, from <http://media.igt.com/marketing/PromotionalLiterature/GamePromoLit_C806-1 B61A.pdf>.*

IGT's News magazine "Slot Line Jun. 25, 2002"; retrieved from the internet on Dec. 5, 2007, from <http://www.igtproducts.com/eupdates/SlotLine/20020625.htm>.*

* cited by examiner

GAMING MACHINE WITH MINE FEATURE

FIELD OF THE INVENTION

This invention relates to a gaming machine. More particularly, the invention relates to a gaming machine and to an improvement to a game played on such a gaming machine.

BACKGROUND TO THE INVENTION

Players who regularly play gaming machines quickly tire of particular games and therefore it is necessary for manufacturers of these machines to develop innovative game features which add interest to the games. In so doing, it is hoped to keep players amused and therefore willing to continue playing the game as well as to attract new players.

Also, with the growth that has occurred in the gaming machine market, there is intense competition between manufacturers to supply various existing and new venues. When selecting a supplier of gaming machines, the operator of a venue will often pay close attention to the popularity of various games with their patrons. Therefore, gaming machine manufacturers are keen to devise games and/or game features which are popular with the players as a mechanism for improving sales, retaining customers and attracting new customers.

In addition, players enjoy having greater interaction with a game such that they feel that they can have an effect on the outcome of the game. However, due to very strict compliance regulations which need to be satisfied in various jurisdictions, it is difficult, if not impossible, to include high levels of player skill in game features of gaming machines. It is desirable to include features where pseudo-skill is involved in the feature which, the applicant believes, will enhance player enjoyment.

SUMMARY OF THE INVENTION

According to a first aspect of the invention, there is provided gaming machine having a display and a game controller arranged to control images of symbols displayed on the display, the game controller being arranged to play a game wherein at least one random event is caused to be displayed on the display means and, if a predefined winning event occurs, the machine awards a prize, the gaming machine further comprising a game feature where, upon being awarded at least one prize in the feature, a player is offered a choice and, if the choice results in a successful outcome, the player has the option of continuing with the feature but, if the choice results in an unsuccessful outcome, the feature ends and a portion, but not all, of a total prize accumulated up to termination of the feature is forfeited.

More particularly, upon being awarded at least one prize, the player may be offered the opportunity to continue to attempt to accumulate further prizes and, at the player's option, for so long as the player is successful in accumulating further prizes, the feature continues but, if the player is unsuccessful, the feature ends and only a part of a total prize accumulated up to termination of the feature is awarded to the player. It will be appreciated that, after the player has obtained a successful outcome, the player may decide to end the feature and to take the winnings from the feature which have been awarded to date rather than continuing with the feature and risking said portion of the prize.

The game feature may be a second screen feature which is triggered when a predetermined trigger condition occurs in a base game. The particular feature to which the invention is applicable is a second screen feature following the Applicant's "Outback Jack™" game.

A screen display of the game feature may display a paytable that indicates the number of credits that will be paid for various successful outcomes which occur during the playing of the feature. Further, the screen display of the second screen feature may include a prize meter which provides a cumulative total of the number of credits won due to successful outcomes which have occurred during the playing of the feature.

When the initial screen display is displayed on the display means, the player may be alerted to commence the feature by pressing a "Start Feature" button on a midtrim of the gaming machine.

At least a first outcome may be guaranteed to be a successful outcome where a player is awarded a prize of a number of credits multiplied by the total bet. If desired, a second outcome may also be guaranteed to be a successful outcome.

It will be appreciated that, because the player has the option of attempting to achieve further successful outcomes, an apparent level of skill is imparted to the game. In other words, the player has a choice of continuing with the feature at the risk of losing a portion of the total prize won to date or ending the feature and taking the total prize won to date.

Should the player wish to continue playing the feature, a probability of success of the outcome may be determined by the controller so that an average total prize awarded for the feature is approximately the same as the total prize the player would get if the player chose to leave the feature. This has the benefit that it allows for an expected return to player percentage of the gaming machine to be accurately calculated without the level of uncertainty which results when player skill has an effect on the outcome.

Should the player desire to continue with the feature, the controller may determine the prize for a subsequent stage of the feature in the same way as for any previous stage of the feature by making a weighted random selection to determine the size of a prize associated with that stage.

A probability of success of the subsequent stage may be dependent upon both the size of the prize for a successful outcome in the subsequent stage as determined by the controller and the size of a total prize that has so far been accumulated. More particularly, the probability of success may be determined by the following equation:—

$$Ps=(\text{Number of credits that may be lost})/(\text{Number of credits that may be lost}+\text{New prize}).$$

The gaming machine may include a selector to allow the player the opportunity of continuing with or leaving the feature. The selector may be in the form of buttons on the midtrim of the gaming machine and/or icons arranged behind touch sensitive zones of the display.

The portion of the total prize which the player forfeits if an unsuccessful outcome occurs if the player continues with the feature may be half the total prize accumulated up to the time of the unsuccessful outcome occurring.

Should the player wish to leave the feature, the player may press the appropriate button or touch the appropriate icon. The feature ends and the total amount on the prize meter may be transferred to a win meter of the gaming machine. Should the player wish to continue with the feature, the player may do so by pressing the appropriate button or touching the appropriate icon. The feature may continue with the risk that the following stage may have an unsuccessful outcome. In that event, half the prize on the prize meter may be forfeited and the remaining half added to the win meter of the gaming machine. The feature is then at an end.

However, should the player continue with the feature and the outcome of the following stage is successful, the resulting prize may be added to the prize meter and the player may then again be offered the option of continuing with the feature or terminating the feature as described above.

As indicated above, to eliminate true skill from the game, the average win may need to remain the same as a total accumulated win that is already displayed on the special prize meter of the second screen feature.

According to a second aspect of the invention, there is provided a method of playing a game on a game playing apparatus, the game playing apparatus having a display and a game controller arranged to control images displayed on the display, the game further comprising a game feature where, upon being awarded at least one prize in the feature, a player is offered a choice and the method including, if the choice results in a successful outcome, providing the player with the option of continuing with the feature but, if the choice results in an unsuccessful outcome, the feature ends and a portion, but not all, of a total prize accumulated up to termination of the feature is forfeited.

A game playing apparatus includes one which does not require the wagering of a stake in order to play the game and further includes apparatus which is connectable to a network.

The method may include implementing the game feature as a second screen feature which is triggered when a predetermined trigger condition occurs in a base game.

The method may include displaying a paytable on a screen display of the game feature, the paytable indicating the number of credits that will be paid for various successful outcomes which occur during the playing of the feature. The screen display of the second screen feature may include a prize meter and the method may include providing a cumulative total of the number of credits won due to successful outcomes which have occurred during the playing of the feature.

The method may further include guaranteeing that at least a first outcome is a successful outcome where a player is awarded a prize of a number of credits.

Should the player wish to continue playing the feature, the method may include determining a probability of success of the outcome so that an average total prize awarded for the feature is approximately the same as the total prize the player would get if the player chose to leave the feature. Further, should the player desire to continue with the feature, the method may include determining the prize for a subsequent stage of the feature in the same way as for any previous stage of the feature by making a weighted random selection to determine the size of a prize associated with that stage.

The method may include making a probability of success of the subsequent stage dependent upon both the size of the prize for a successful outcome in the subsequent stage as determined by the controller and the size of a total prize that has so far been accumulated.

In particular, the method may include determining the probability of success by the following equation:—

$$Ps=(\text{Number of credits that may be lost})/(\text{Number of credits that may be lost}+\text{New prize}).$$

The method may include setting the portion of the total prize which the player forfeits if an unsuccessful outcome occurs if the player continues with the feature as half the total prize accumulated up to the time of the unsuccessful outcome occurring.

BRIEF DESCRIPTION OF THE DRAWINGS

The invention is now described by way of example with reference to the accompanying diagrammatic drawings in which:—

DETAILED DESCRIPTION OF THE DRAWINGS

Figure 1:
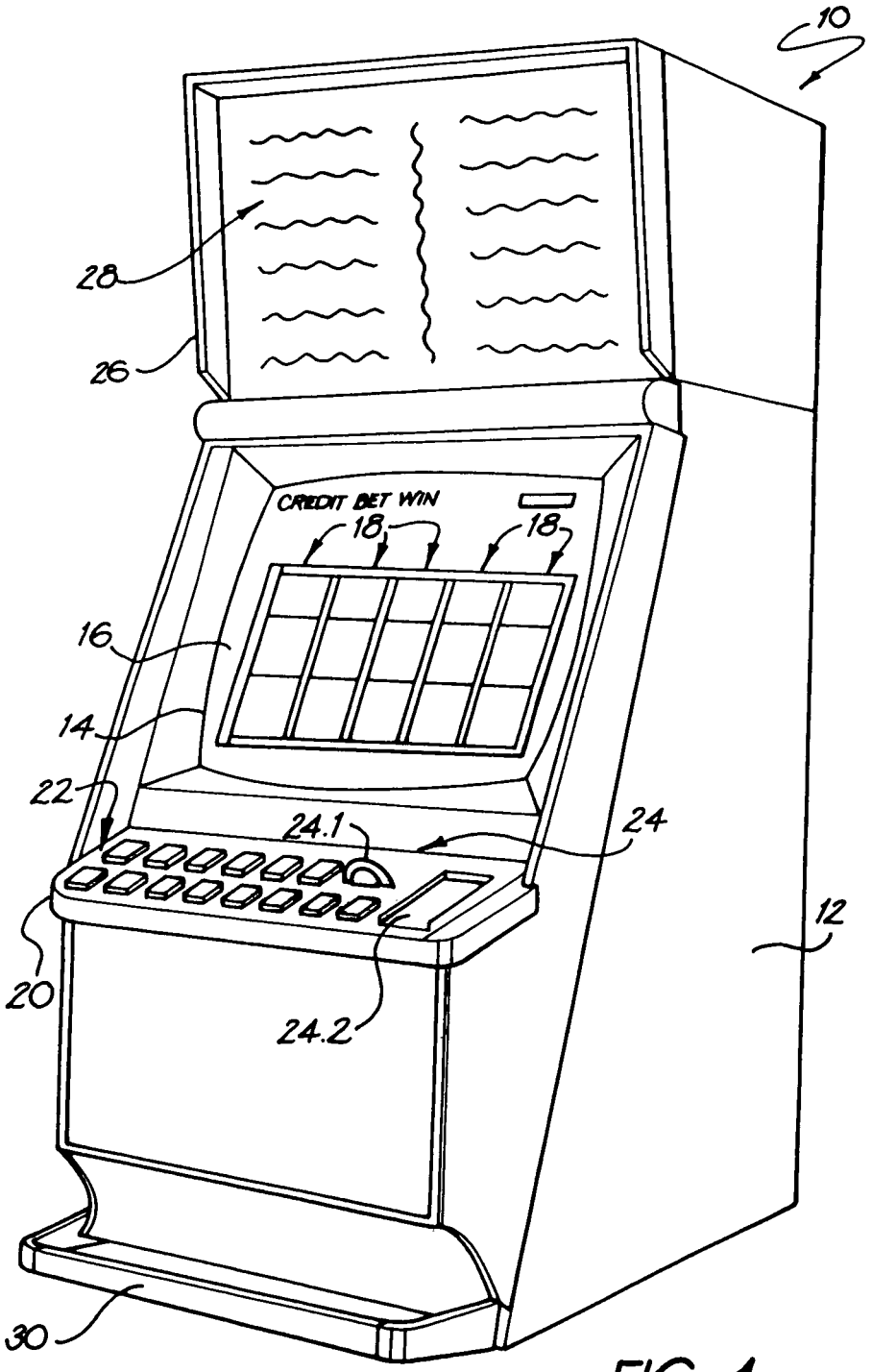
FIG. 1 shows a perspective view of a gaming machine, in accordance with the invention.

In FIG. 1, reference numeral 10 generally designates a gaming machine, including a game, in accordance with the invention. The machine 10 includes a console 12 having a display in the form of a video display unit 14 on which a game 16 is played, in use. The video display unit may be implemented as a cathode ray tube device, a liquid crystal display, a plasma screen, or the like. The game 16 is a spinning reel game which simulates the rotation of a number of spinning reels 18. A midtrim 20 of the machine 10 houses a bank 22 of buttons for enabling a player to play the game 16. The midtrim 20 also houses a credit input mechanism 24 including a coin input chute 24.1 and a bill collector 24.2.

The machine 10 includes a top box 26 on which artwork 28 is carried. The artwork 28 includes paytables, details of bonus awards, etc.

A coin tray 30 is mounted beneath the console 12 for cash payouts from the machine 10.

Figure 2:
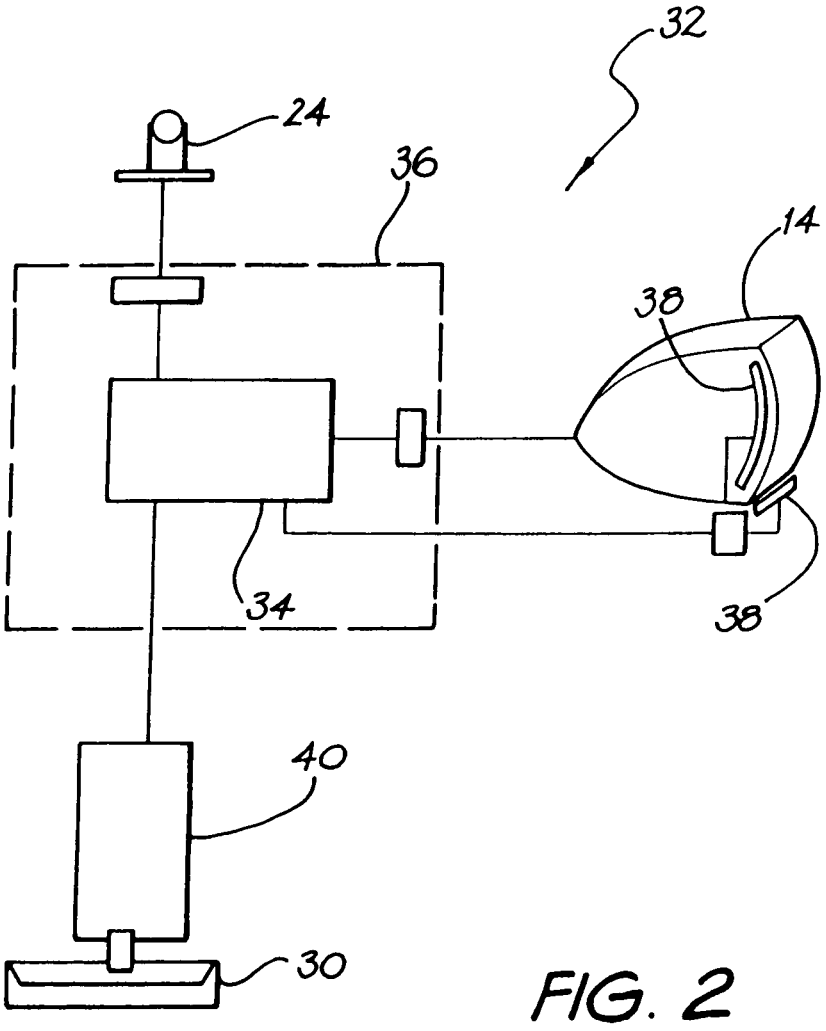
FIG. 2 shows a block diagram of a control circuit of the gaming machine.

Referring now to FIG. 2 of the drawings, a control circuit 32 is illustrated. A program which implements the game and user interface is run on a processor 34 of the control circuit 32. The processor 34 forms part of a controller 36 that drives the screen of the video display unit 14 and that receives input signals from sensors 38. The sensors 38 include sensors associated with the bank 22 of buttons and touch sensors mounted in the screen of the video display unit 14. The controller 36 also receives input pulses from the mechanism 24 to determine whether or not a player has provided sufficient credit to commence playing. The mechanism 24 may, instead of the coin input chute 24.1 or the bill collector 24.2, or in addition thereto, be a credit card reader (not shown) or any other type of validation device.

Finally, the controller 36 drives a payout mechanism 40 which, for example, may be a coin hopper for feeding coins to the coin tray 30 to make a pay out to a player when the player wishes to redeem his or her credit.

Figure 3:
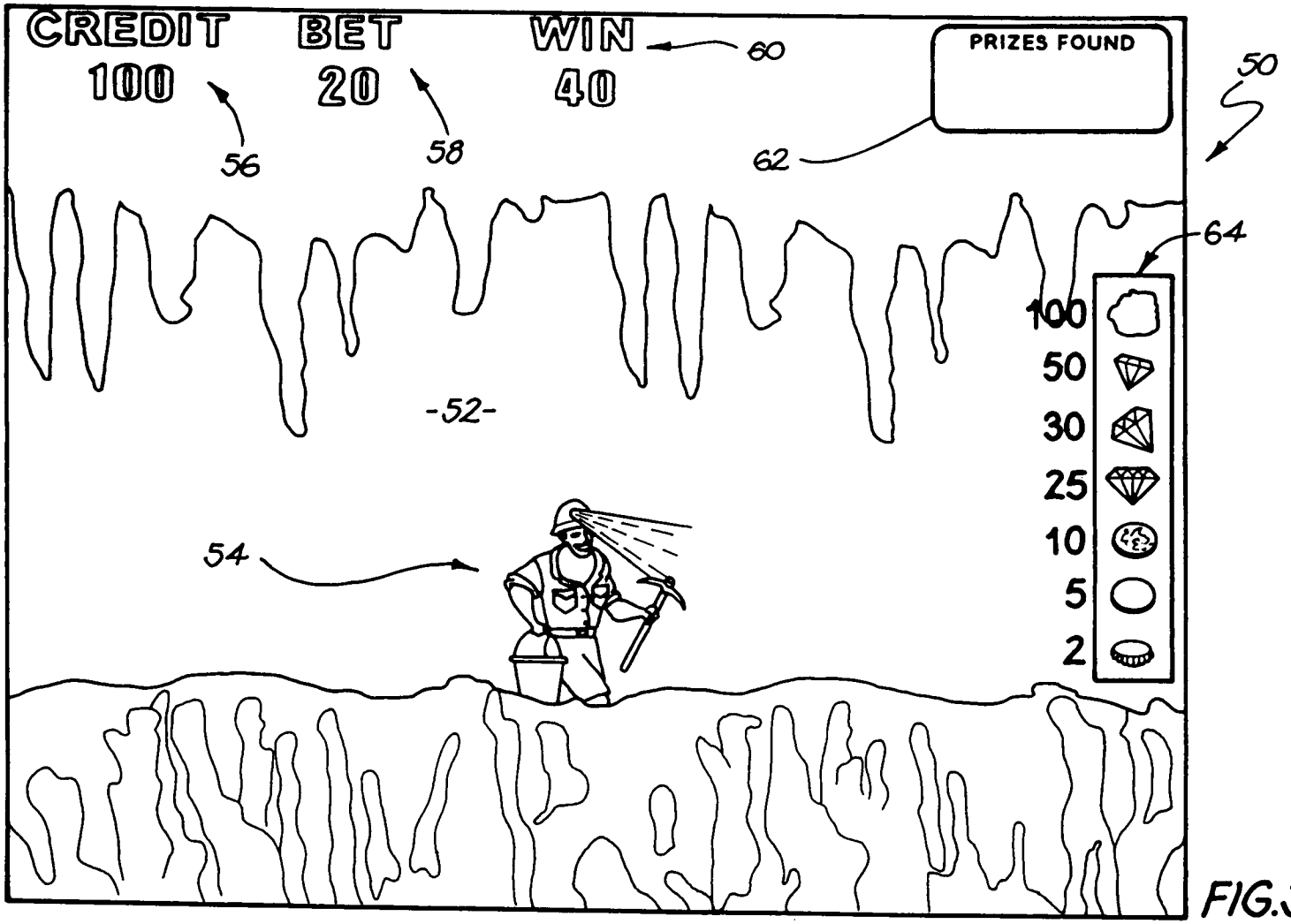
FIG. 3 shows an initial screen display of a game feature of a game played on the gaming machine of FIG. 1.

Referring to FIG. 3 of the drawings, an initial screen display of a game feature, in accordance with the invention, is illustrated and is designated generally by the reference numeral 50. The screen display 50 follows the triggering of a feature in an underlying base game of the game 16. As indicated above, the base game is the Applicant's "Outback Jack™" game. In that base game, when a trigger condition occurs a second screen display is shown being a map of Australia. A number of icons are displayed on the map. Each icon represents a feature. One of the features is the game feature of the present invention and is indicated as a "Gold Mine" feature.

Should the player select the Gold Mine feature, the screen display 50 as shown in FIG. 3 of the drawings appears on the video display unit 14 of the gaming machine 10. It is to be noted that the screen display represents a graphical representation of a mine tunnel 52 with an animated character, "Outback Jack", 54 in the tunnel 52.

In addition to a credit meter 56, a bet meter 58 and a win meter 60, a prize meter 62 is also displayed in the screen display. A paytable 64 is also displayed in the screen display 50. The paytable 64 shows the number of credits to be awarded if one of the minerals or precious stones in the paytable are "dug up" by the character 54.

To start the feature, a "Start Feature" button from the bank 22 of buttons is pressed. The character 54 digs up a randomly selected item (a mineral or gem stone) and the appropriate prize is paid depending on the item dug up.

Figure 4:
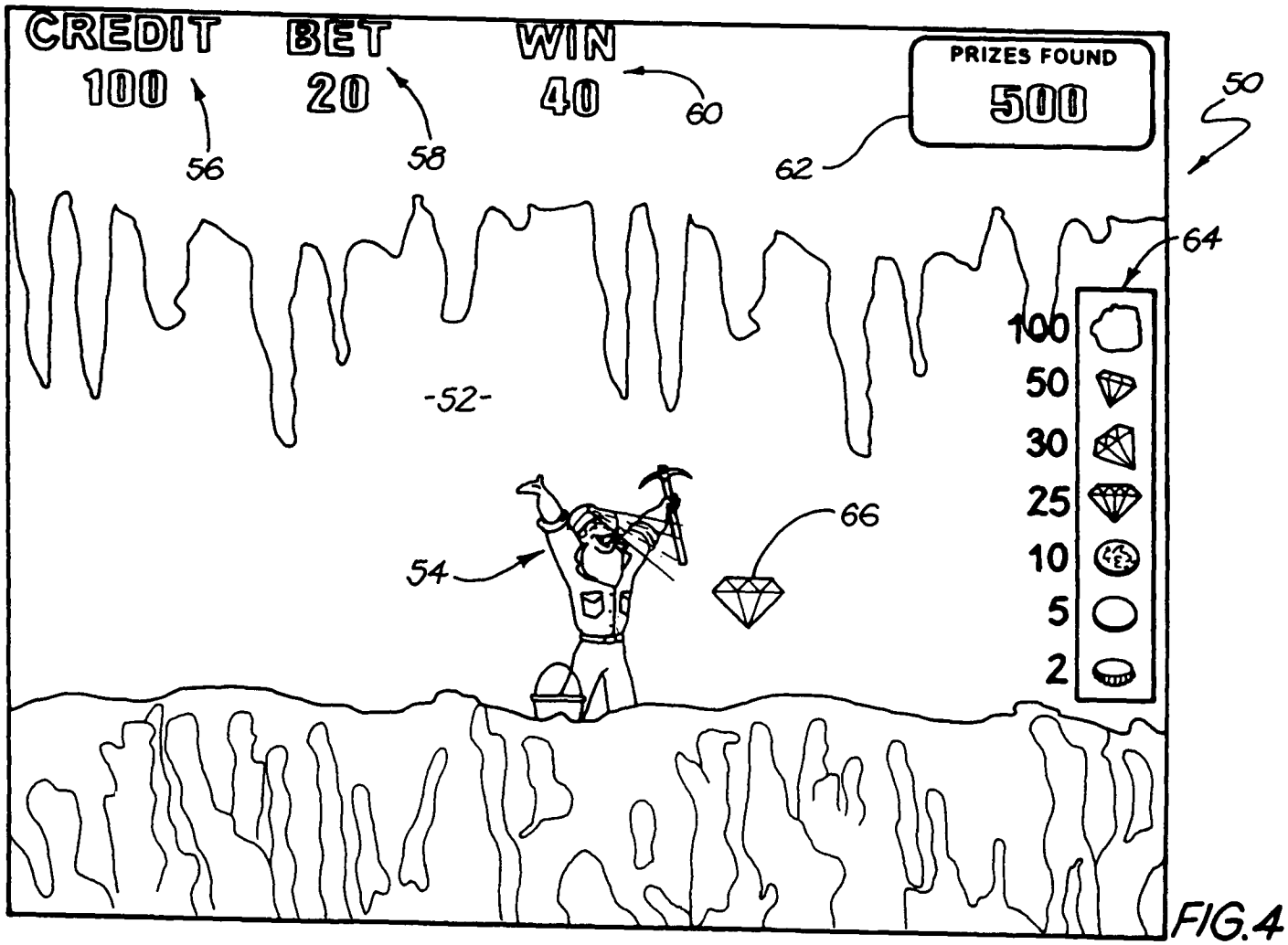
FIGS. 4 to 6 show subsequent screen displays of the game feature.

For example, as shown in FIG. 4 of the drawings, the character 54 has dug up a ruby 66. From the paytable 64, it is to be noted that a ruby 66 is worth 25 credits. The prize awarded is the number of credits associated with the item "dug up" multiplied by the bet. Therefore, in this case, the prize awarded is 25×20=500 and 500 credits is credited to the prize meter 62.

Figure 5:
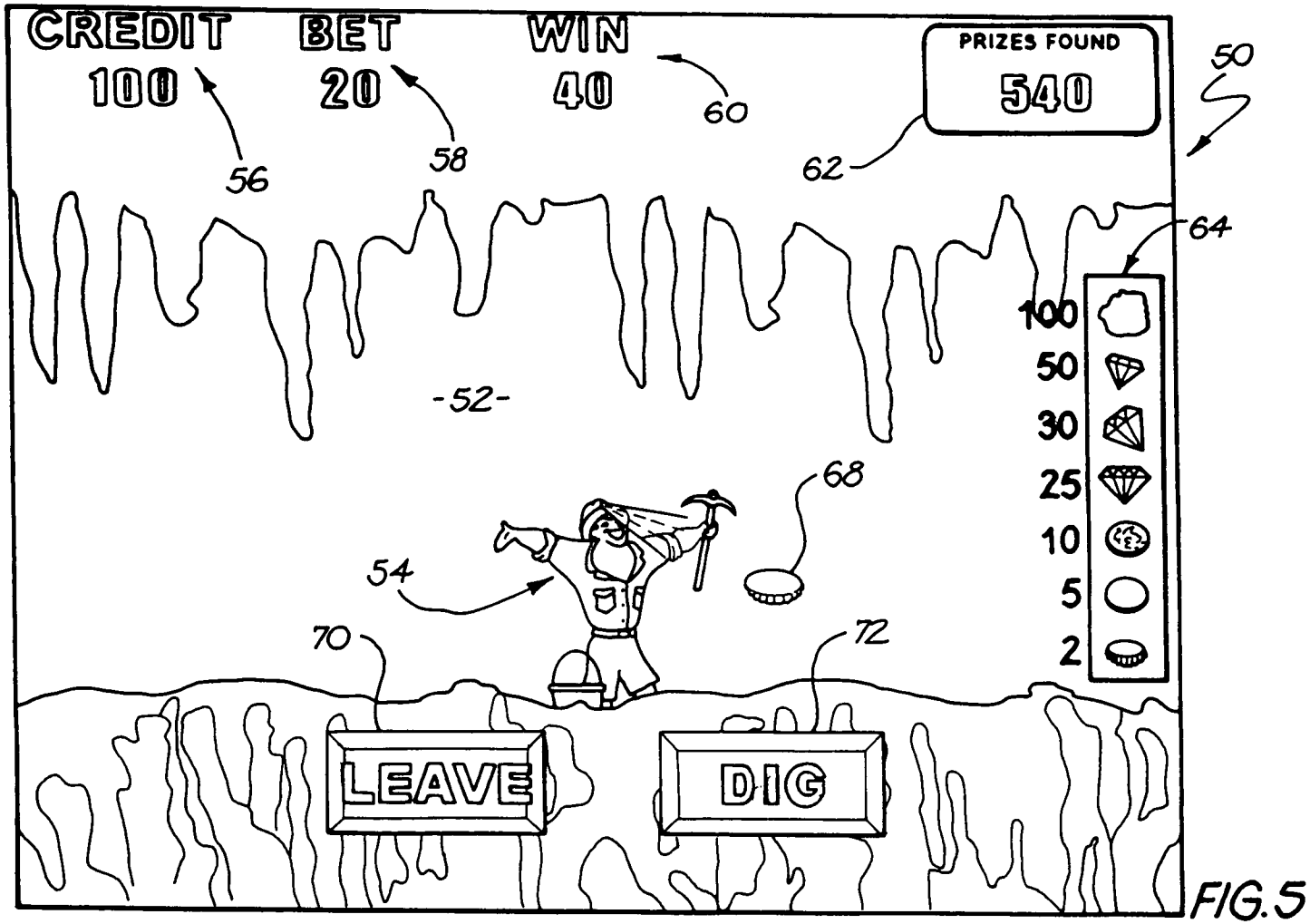

The character 54 then digs up a second item 68 which is worth 2 credits as shown on the paytable 64. Once again, the value of the item is multiplied by the bet to provide the total prize awarded so that a prize of 40 credits is credited to the prize meter 62 as shown in FIG. 5 of the drawings.

It will therefore be seen that the first two outcomes are guaranteed to be successful and no player choice is involved.

After the second prize has been paid, two icons 70, 72 are displayed on the screen display 50. The icon 70 is a "Leave" icon and the icon 72 is a "Dig" icon. The Dig icon 72 is selected by the player should the player wish to continue playing the game feature. Thus, a choice is offered to the player. The player can either terminate the game feature by touching the Leave icon 70 or can continue playing the game feature by touching the Dig icon 72.

Should the player touch the Leave icon 70, the total prize credited to the prize meter (in this case a credit of 540 credits) is applied to the win meter 60 of the gaming machine 10 and the feature is at an end. Should the player wish to continue playing the game feature, the player touches the Dig icon 72 and is afforded the opportunity of digging up further items potentially to increase the size of the total prize awarded in the feature but at the risk of forfeiting a portion, but not all, of the total prize standing to the credit of the player on the prize meter 62.

Figure 6:
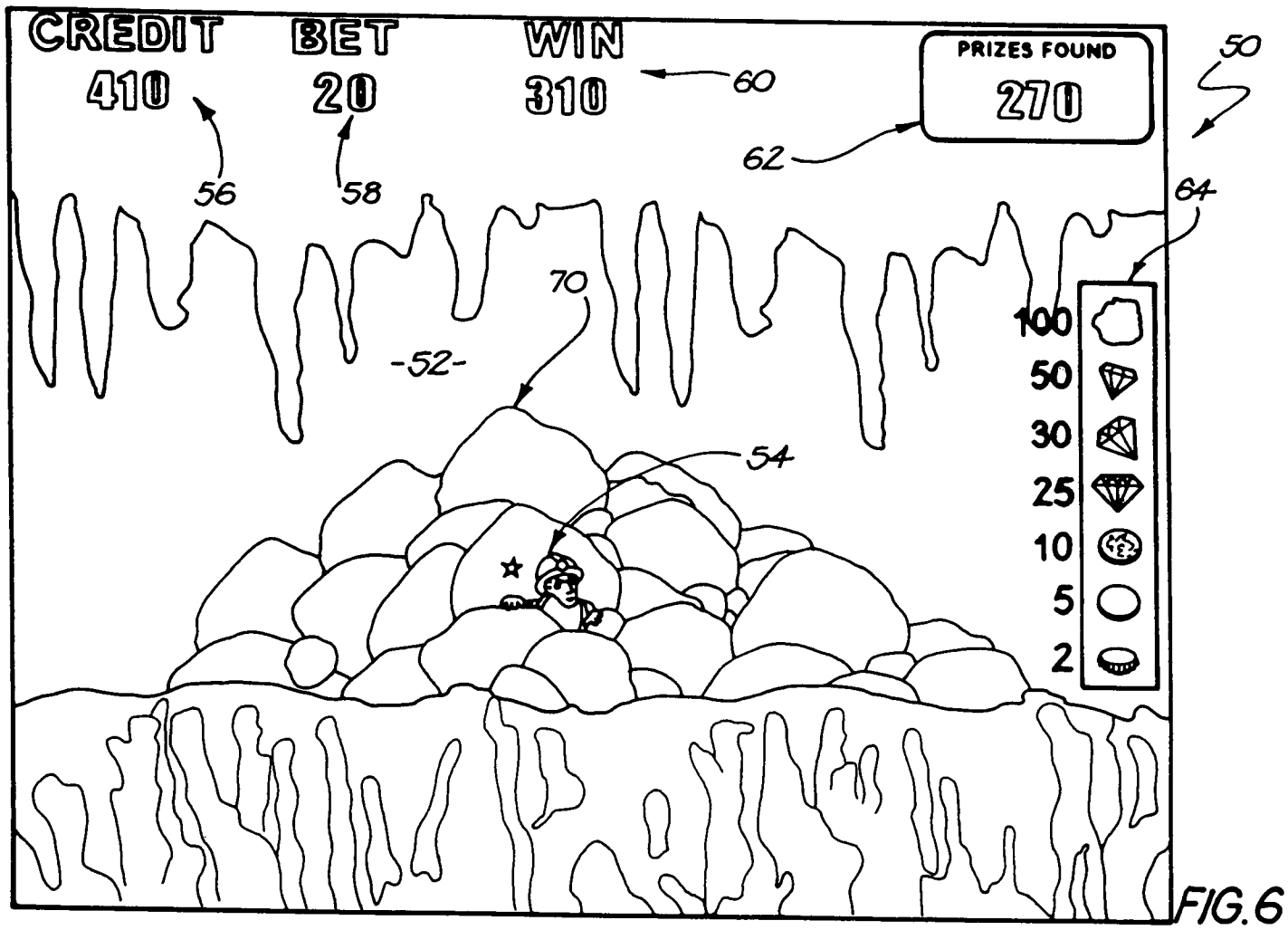
Figure 7A:
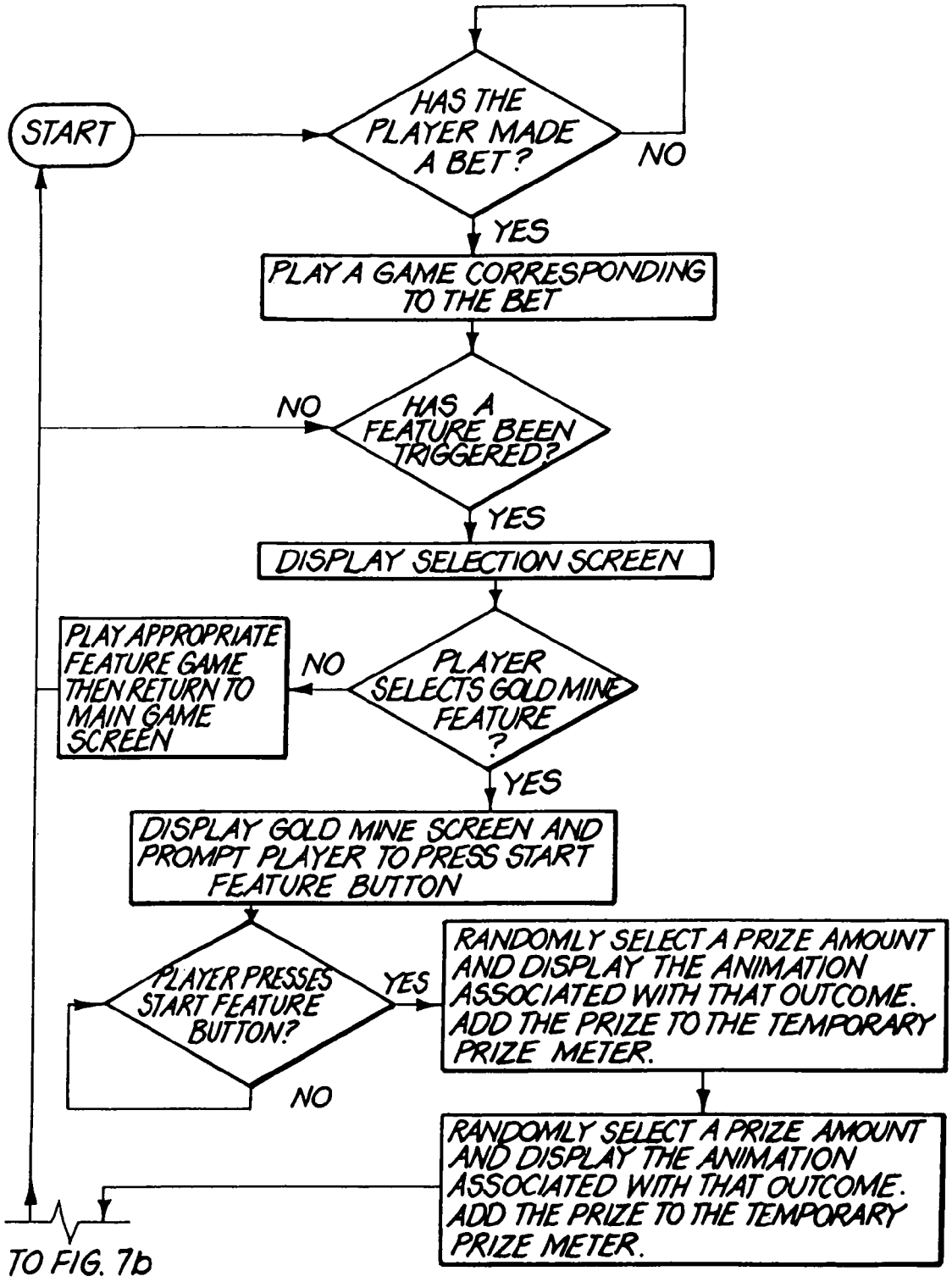
FIG. 7 shows a flow chart of a game played on the gaming machine of FIG. 1 including the game feature of FIGS. 3 to 6.
Figure 7B:
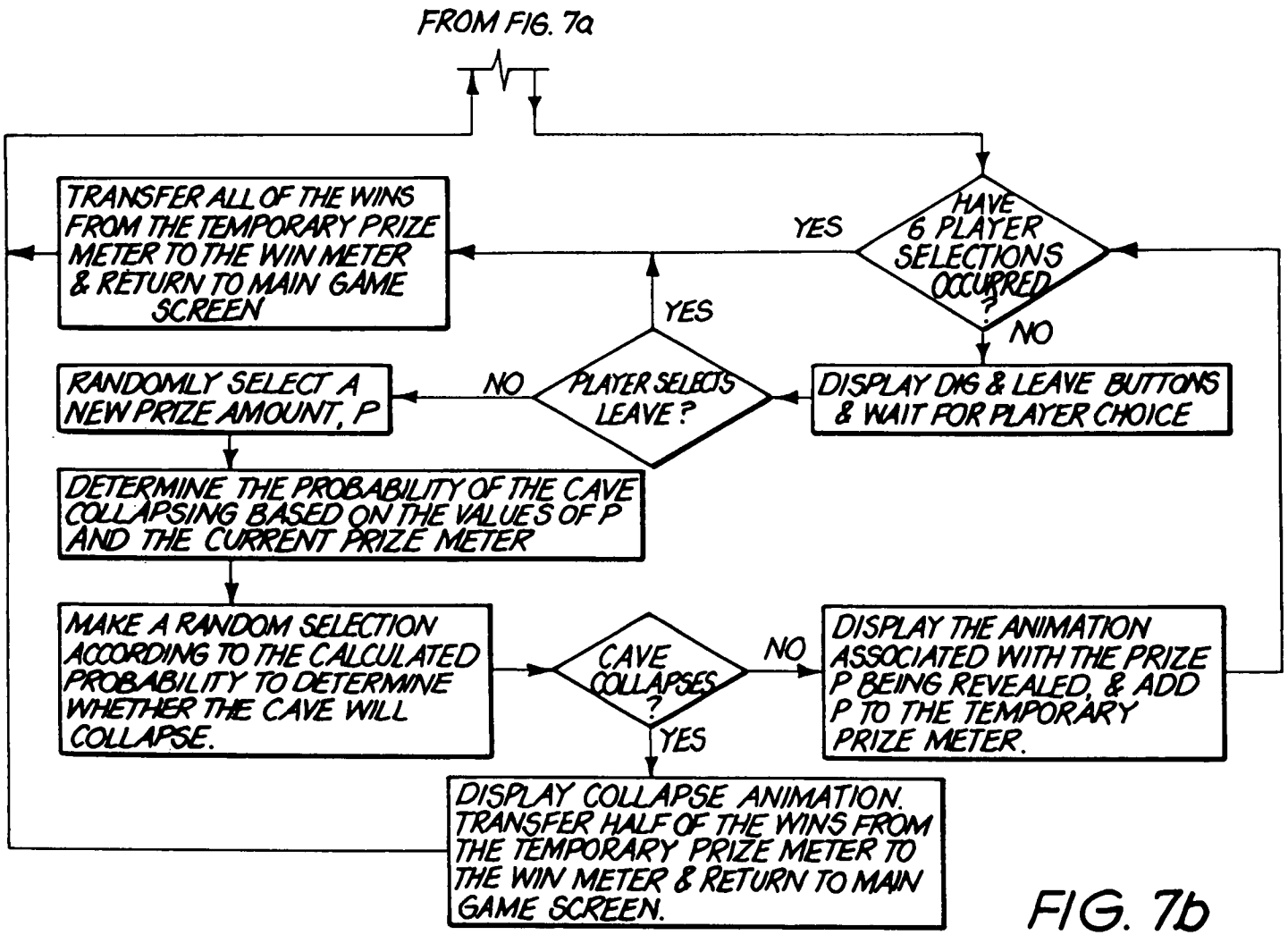

In the illustrated example, it is assumed that the player touches the Dig icon 72 in an attempt to increase the total prize awarded in the game feature. As illustrated in FIG. 6 of the drawings, the player achieves an unsuccessful outcome and the tunnel 52 collapses as illustrated by the rocks 70 in FIG. 6 of the drawings. More importantly, the prize standing to the credit of the player on the prize meter 62 is halved so that the previous prize of 540 is now 270 credits. The prize of 270 credits remaining on the prize meter 62 is credited to the win meter 60 and the game feature is at an end.

Had the player been successful in "digging" up a further item, the player would again then have been offered the opportunity of continuing with the feature or terminating the feature. Theoretically, the feature can continue indefinitely so long as the player is successful with their "dig" attempts but in practice a limit of eight "digs" is imposed including the first two digs.

The controller 36 determines whether or not, at each stage of the feature where the player is offered a "Leave" or "Dig" choice, the outcome will be successful. Although, by offering the player a choice, it appears that player skill is involved, it is, more correctly, pseudo-skill. Pseudo-skill is used because it allows for the expected return to player percentage of the gaming machine 10 to be accurately calculated without the level of uncertainty that results when true skill has an effect on the outcome of the game.

Should the player decide to continue with the feature by touching the Dig icon 72, one of two things will happen. Either the character 54 will dig up another item to increase the prize on the prize meter 62 or the tunnel 52 will collapse.

To eliminate skill from the game 16, the average win for the feature needs to remain the same as the total accumulated win that is currently displayed on the prize meter 62. Hence, when the player chooses to continue with the game feature by touching the Dig icon 72, a prize is determined in the same way as for previous prizes awarded. That is, a weighted random selection is made by the controller 36 to determine which item from the paytable 64 will be revealed and, hence, the size of the next prize. After the item has been determined, the probability of success, i.e. whether the outcome will be successful or not, is determined by the following equation:

$$Ps=(\text{Number of credits that may be lost})/(\text{Number of credits that may be lost}+\text{New prize}).$$

The probability of the outcome being unsuccessful in that the tunnel 52 collapses is therefore dependent upon both the next item selected from the paytable and the size of the total prize that has so far been accumulated on the prize meter 62.

Once the probability of success has been determined in this way, a selection is made according to that probability to decide whether the player has a successful or unsuccessful outcome, the latter ending the feature.

For example, if the player is lucky enough to get the maximum prize of 100 as shown on the paytable 64 twice in a row before deciding to continue with the feature by touching the Dig icon 72, then, if the 25 credit item is selected as the third prize, the player would have a 20 percent chance of winning half the current prize on the prize meter 62, ie. a prize of 100 credits, in that the outcome is regarded as unsuccessful and is designated as such by the tunnel 52 collapsing. Conversely, the player has an 80 percent chance of having a successful outcome in which case the total prize would be 225 credits.

On average, this works out to be exactly the same as if the player had selected to end the feature by touching the Leave icon 70 after twice winning the 100 credit prize.

Accordingly, it is an advantage of the invention that a game feature is provided which includes apparent player skill thereby resulting in greater interaction by a player with the game such that the player feels that he or she has an effect on the outcome of the game.

It is a further advantage of the invention that the mathematics is selected so that the expected return to player percentage of the gaming machine 10 can be accurately calculated without the level of uncertainty that results when real skill has an effect on the outcome of the game.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A gaming machine comprising:

a display;

a credit input mechanism configured to accept a physical item associated with a monetary value to establish credit within a credit balance for a player to play a game;

a payout mechanism configured to provide monetary credits based on successful game outcomes; and a game controller configured, and in response to the credit input mechanism having accepted the physical item to establish credit within the credit balance, to:

control images of symbols to be displayed on the display, affect on the display a bonus feature wherein at least a first outcome is guaranteed to be a successful outcome to result in a first amount of prize credits, said first amount of prize credits being randomly determined, accumulate the first amount of prize credits into a total prize;

offer through the display a choice to select between (a) continuing the bonus feature, and (b) ending the bonus feature, and, in response to a choice selection of (a) continuing the bonus feature, said game controller configured to:

(1) determine a subsequent prize of the bonus feature from a plurality of prizes for a successful subsequent outcome, (2) determine a second amount of said prize credits to be risked in selecting to continue the bonus feature, said second amount being a portion of said first amount, (3) accumulate the subsequent prize credits into the total prize, and determine the size of the accumulated total prize for a successful subsequent outcome of the bonus feature, (4) calculate a ratio of the successful subsequent outcome based on (i) said subsequent prize for a successful subsequent outcome, (ii) said second amount of said prize credits to be risked in selecting to continue the bonus feature, and (iii) the size of the accumulated total prize for a successful subsequent outcome of the bonus feature, so that the average win of the feature is said first amount;

(5) display an occurrence of said subsequent outcome indicative of the calculated ratio, (6) in response to said subsequent outcome being a successful outcome, offer through the display the choice of continuing the bonus feature; and (7) in response to said subsequent outcome being an unsuccessful outcome, i) end the bonus feature, and ii) forfeit said second amount of said prize credits; and the payout mechanism providing any monetary prize credits to the player.

2. The gaming machine of claim 1, wherein the game controller is configured to affect the bonus feature when a predetermined trigger condition occurs in a base game.

3. The gaming machine of claim 1, wherein the game controller is configured to display on the display a paytable that indicates a number of credits that will be paid for various successful outcomes which occur during the playing of the bonus feature.

4. The gaming machine of claim 3, wherein the game controller is configured to display on the display a prize meter which provides a cumulative total of credits won due to successful outcomes which have occurred during the playing of the bonus feature.

5. The gaming machine of claim 1, wherein said game controller is configured to determine said subsequent prize for a successful subsequent outcome using a weighted random selection.

6. The gaming machine of claim 1, wherein said calculated ratio of the successful subsequent outcome is calculated by the following equation:

$$Ps=(\text{said second amount of prize credits})/(\text{said second amount of prize credits}+\text{said subsequent prize}).$$

7. A method of playing a game on a game playing apparatus having a credit input mechanism configured to accept a physical item associated with a monetary value to establish credit within a credit balance for a player to play the game, a display, a payout mechanism configured to provide monetary credits based on successful game outcomes, and a game controller, the method comprising:

in response to the credit input mechanism having accepted the physical item to establish credit within the credit balance, displaying on the display a bonus feature guaranteeing a successful first outcome to result in a first amount of prize credits;

accumulating via the controller the first amount of prize credits into a total prize;

offering on the display a choice to select between (a) continuing the bonus feature and (b) ending the bonus feature;

in response to a choice selection of (a) continuing the bonus feature on the display, (1) determining via the controller a subsequent prize from a plurality of prizes for a successful subsequent outcome;

(2) determining via the controller a second amount of said prize credits to be risked in selecting to continue the bonus feature, said second amount being a portion of said first amount;

(3) accumulating via the controller the subsequent prize credits into the total prize, and determining via the controller the size of the accumulated total prize for a successful subsequent outcome of the bonus feature;

(4) calculating via the controller a ratio of the successful subsequent outcome based on (i) said subsequent prize for a successful subsequent outcome, (ii) said second amount of said prize credits to be risked in selecting to continue the bonus feature, and (iii) the size of the accumulated total prize for a successful subsequent outcome of the bonus feature, so that the average win of the feature is said first amount;

(5) displaying on the display an occurrence of said subsequent outcome indicative of the calculated ratio;

(6) in response to said subsequent outcome being a successful outcome, offering through the display the choice of continuing the bonus feature; and (7) in response to said subsequent outcome being an unsuccessful outcome, i) ending the bonus feature, and ii) forfeiting said second amount of said prize credits; and the payout mechanism providing any monetary prize credits to the player.

8. The method of claim 7, and further comprising triggering the bonus feature when a predetermined trigger condition occurs in a base game.

9. The method of claim 7 wherein the game playing apparatus includes a screen display, and further comprising displaying a paytable on the screen display of during the bonus feature; and indicating in the paytable a number of credits that will be paid for various successful outcomes of the bonus feature.

10. The method of claim 9, and further comprising displaying a prize meter; and providing a cumulative total of the number of credits won due to successful outcomes.

11. The method of claim 7, and further comprising determining said subsequent prize for a successful subsequent outcome with a weighted random selection.

12. The method of claim 7, wherein said calculating said ratio of the successful subsequent outcome comprises using the following equation:

$Ps$=(said second amount of prize credits)/(said second amount of prize credits+said subsequent prize).

* * * * *